US006933268B2

(12) United States Patent
White

(10) Patent No.: US 6,933,268 B2
(45) **Date of Patent: *Aug. 23, 2005**

(54) LIQUID PROTECTANT COMPOSITION

(75) Inventor: James L. White, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 176 days.

This patent is subject to a terminal disclaimer.

(21) Appl. No.: 10/358,773

(22) Filed: Feb. 5, 2003

(65) Prior Publication Data

US 2003/0114344 A1 Jun. 19, 2003

Related U.S. Application Data

(63) Continuation of application No. 09/616,591, filed on Jul. 14, 2000, now Pat. No. 6,531,440.

(51) Int. Cl.[7] ..... C11D 17/00
(52) U.S. Cl. ..... 510/405; 510/244; 510/403
(58) Field of Search ..... 510/405, 244, 510/403

(56) References Cited

U.S. PATENT DOCUMENTS 3,956,174 A 5/1976 Palcher
4,512,677 A 4/1985 Trinh
4,600,436 A 7/1986 Traver et al.
5,346,640 A 9/1994 Leys
5,374,362 A 12/1994 McFarland
5,518,533 A 5/1996 Howe
5,705,083 A 1/1998 Wyss et al.
5,955,536 A 9/1999 Popa et al.
6,013,323 A 1/2000 Klayder et al.
6,531,440 B1 * 3/2003 White ..... 510/405

* cited by examiner

*Primary Examiner*—Yogendra N. Gupta
*Assistant Examiner*—John M. Petruncio
(74) *Attorney, Agent, or Firm*—David B. Patchett

(57) ABSTRACT

A liquid protectant composition which cleans, protects, preserves, and enhances the appearance of rubber, synthetic plastic, and vinyl surfaces includes a cleaning agent, silicone, a thickener, a neutralizing agent, an ultra-violet light absorber, and water. The composition also preferably includes a fragrance and a fragrance stabilizer. When the fragrance and fragrance stabilizer are present in the formulation, the composition preferably has a viscosity ranging from about 7.5 Pa*sec (7,500 cPs) to about 18 Pa*sec (18,000 cPs) which allows the composition to be applied easily to a variety of surfaces.

7 Claims, No Drawings

LIQUID PROTECTANT COMPOSITION

This application is a continuation application of U.S. application Ser. No. 09/616,591, filed Jul. 14, 2000, now as U.S. Pat. No. 6,531,440, which is hereby incorporated by reference in its entirety.

FIELD OF THE INVENTION

The present invention relates generally to a liquid protectant composition for cleaning, protecting, and enhancing the appearance of rubber, synthetic plastic, and vinyl surfaces.

BACKGROUND OF THE INVENTION

Many automotive and household products such as automobiles, boats, luggage, and outdoor furniture include rubber, plastic, and vinyl materials. Environmental factors, however, such as heat, ultra-violet light, ozone, and dirt can prematurely age and damage these materials. As a result, protectant products have been developed to clean, preserve, and protect rubber, plastic, and vinyl surfaces against the harmful effects of the environment, and improve the appearance of such surfaces.

Currently available protectant products are generally provided as liquids which are sprayed onto a surface. Such sprayable liquid protectants, however, often exhibit poor coverage characteristics, and are prone to the problem of overspray which can occur, for example, when spraying the liquid protectant on the dashboard of a vehicle and the liquid is sprayed onto the inside surface of the windshield. In addition, such sprayable liquid protectants tend to run or drip if applied too heavily. Protectant compositions are also available in thick gels which do not flow, are difficult to apply, and provide poor coverage.

In addition, currently available protectants may leave a greasy slippery feel, may leave a glossy surface which is too reflective and shiny, and may leave a surface which attracts dust.

Compositions for protecting rubber, plastic, vinyl, and the like are known in the patented prior art. The McFarland U.S. Pat. No. 5,374,362 for example, discloses several ultra-violet light protection formulas in the form of liquids and creams which can be topically applied to various surfaces, such as leather, wood, and vinyl, to protect the surface from the harmful effects of light.

The Wyss et al. U.S. Pat. No. 5,705,083 discloses a process for improving the resistance of plastics, leather, and imitation leather to the influence of light and/or heat, comprising treating these substrates with an aqueous emulsion or dispersion comprising an emulsifier or dispersant and a water-insoluble sterically hindered amine, a water-insoluble UV absorber and/or a water-insoluble antioxidant and, if appropriate, water and other additives.

The Popa et al. U.S. Pat. No. 5,955,536 discloses a method for treating plastic, leather or rubber surfaces with a composition comprising a polyisobutylene (PIB) oligomer and a polydimethylsiloxane (PDMS) fluid.

The Klayder et al. U.S. Pat. No. 6,013,323 discloses a silicone gel protectant useful for protecting and enhancing the appearance of vinyl, leather, rubber, and plastic surfaces such as those found in car interiors, car trim and car bumpers.

There remains a need, however, for improved compositions for cleaning, protecting, and enhancing the appearance of rubber, synthetic plastic, and vinyl surfaces. It would therefore be desirable to provide a protectant composition which cleans, protects, and enhances the appearance of rubber, synthetic plastic, and vinyl surfaces which is easy to apply, does not leave the surface feeling slippery or greasy, which provides a restored finish which is not excessively glossy, and which does not attract dust.

SUMMARY OF THE INVENTION

The present invention provides a liquid protectant composition which cleans, protects, preserves, and enhances the appearance of rubber, synthetic plastic, and vinyl surfaces and the like, which has superior coverage and flow characteristics suitable for both smooth and textures surfaces, which is easy to apply to both horizontal and angled surfaces, which does not leave the treated surface feeling excessively slippery or greasy, which provides a surface finish which is shiny but not excessively glossy or reflective, and which does not attract dust.

In one aspect, the present invention provides a liquid protectant composition including a cleaning agent, silicone, a thickener, a neutralizing agent, an ultra-violet light absorber, and water. In another aspect of the invention, the composition includes a fragrance and a fragrance stabilizer. According to a specific aspect of the invention, the composition has the texture of a typical hand lotion. More specifically, when fragrance and a fragrance stabilizer are present in the composition, the composition has a viscosity ranging from about 5 Pa*sec (5,000 centipoise (cPs)) to about 20 Pa*sec (20,000 cPs), preferably from about 7.5 Pa*sec (7,500 cPs) to about 18 Pa*sec (18,000 cPs), and more preferably from about 10 Pa*sec (10,000 cPs) to about 14 Pa*sec (14,000 cPs). Without the fragrance and fragrance stabilizer, the composition generally has a viscosity between about 5 Pa*sec (5,000 cPs) to about 25 Pa*sec (25,000 cPs), preferably from about 10 Pa*sec (10,000 cPs) to about 20 Pa*sec (20,000 cPs), and more preferably from about 11 Pa*sec (11,000 cPs) to about 16 Pa*sec (16,000 cPs).

The composition generally includes less than about 20 percent cleaner by weight, less than about 25 percent silicone, less than about 3.0 percent thickener, less than about 5 percent neutralizing agent, less than about 5 percent ultra-violet light absorber, and between about 35 percent to about 75 percent water. The cleaner preferably comprises a mixture of propylene glycol monomethylether and isopropanol.

In another embodiment, the liquid protectant composition comprises between about 1 percent and about 15 percent cleaner, between about 5 percent and about 15 percent silicone, between about 0.1 percent and about 1.0 percent thickener, between about 0.5 percent and about 5.0 percent neutralizing agent, between about 0.1 percent and about 1.0 percent ultra-violet light absorber, between about 1.0 percent and about 5.0 percent fragrance, between about 1.0 percent and about 5.0 percent fragrance stabilizer; and between about 55 percent and about 70 percent water, and has a viscosity ranging from about 7.5 Pa*sec (7,500 cPs) to about 18 Pa*sec (18,000 cPs).

Other features and advantages of the invention will be apparent from the following description of the preferred embodiments thereof, and from the claims.

DETAILED DESCRIPTION

According to the present invention, there are provided compositions for cleaning, preserving, protecting, and otherwise treating rubber, synthetic plastic, and vinyl surfaces and the like to enhance the appearance thereof. The compositions exhibit improved coverage and flow characteristics over conventional compositions and are suited for both smooth and textures surfaces, and are easy to apply to both vertical and angled surfaces without running or dripping excessively. These characteristics are achieved by formulating the compositions to a specific range of viscosities as described below. In addition, the compositions of the present invention do not leave the treated surface feeling excessively slippery or greasy, provides a surface finish which is shiny but not excessively glossy or reflective, and does not attract dust.

The compositions generally include at least one cleaning agent which serves to clean the treated surface and may aid in the emulsification of the ultraviolet light absorber. The compositions further include silicone, a thickener, a neutralizing agent, an ultra-violet light absorber, and water, preferably deionized water. To facilitate the formation of a stable emulsion, the silicone is preferably provided as a silicone emulsion. Although optional, the composition preferably includes a fragrance and a fragrance stabilizer. Each of these components is described in more detail below.

Cleaning Agent

A cleaning agent is provided to remove dirt, grease, and other unwanted impurities from the surface to be treated. The particular cleaning agent employed in a composition may be selected depending on the particular end use application, and particularly on the type of surface to be treated. In addition, the cleaning agent may serve as a solvent to help solubilize the UV absorber and maintain the composition as an emulsion.

Suitable cleaning agents include alcohols, such as ethanol and butanol, mono and di-alkyl ethers of alkaline glycols including propylene glycol alkyl ethers such as monomethyl ether and dimethyl ether, and hydrocarbon cleaning agents such as pinene and/or camphene, terpinene, limonene, terpinolene, terpineol, linaleol, and other related members of the terpene family. Acetates such as ethyl acetate and hexyl acetate may also be suitable for certain surfaces but were found to be less preferred for vinyl surfaces which can be damaged by such cleaning agents. Preferred cleaning agents include propylene glycol monomethylether and isopropanol. In a preferred embodiment, the cleaning agent comprises a mixture of propylene glycol monomethylether and isopropanol. Propylene glycol monomethylether is a water soluble cleaning agent available from Olin Chemicals, Brandenburg, Ky. which is well suited for removing grease and was also found to work well with the preferred UV absorber described below.

The composition generally includes cleaning agent in an amount of less than 20 percent by weight, preferably between about 1.0 percent and about 15 percent by weight, and more preferably between about 2.5 percent and about 12 percent by weight.

Silicone

Silicone is included in the composition to provide gloss and control dust, and thereby enhances the appearance of the treated surface. The silicone is preferably provided as an emulsion since it was found that silicone emulsions were easier to incorporate into the composition. Generally, silicone is provided in an amount sufficient to provide a finish which is glossy but not excessively shiny, glary, or reflective. The silicone is preferably an amino functional silicone-wax grafted copolymer which exhibits good detergent resistance. Suitable silicones include GENESEE GP-7105-E available from Genesee Polymer Corporation, Flint, Mich., which is an amino functional silicone-wax grafted copolymer, and Union Carbide ALE-75 available from Witco Corporation, Friendly, W. Va., which is an emulsion blend of an amino functional silicone and a dimethylsilicone oil. The composition generally includes silicone in an amount of less than 25 percent by weight, preferably between about 5 percent and about 15 percent by weight, and more preferably between about 10 percent and 15 percent by weight.

Thickener

A thickener is provided to increase the viscosity of the composition. The thickener is preferably present in an amount sufficient so that the composition can be applied to both horizontal and angled surfaces without excessive running or dripping and to allow the composition to be applied easily to both smooth and textured surfaces. The compositions generally include sufficient thickener to provide the desired viscosity of the composition. More specifically, when fragrance and a fragrance stabilizer are present in the composition, the composition generally has a viscosity ranging from about 5 Pa*sec (5,000 centipoise (cPs)) to about 20 Pa*sec (20,000 cPs), preferably from about 7.5 Pa*sec (7,500 cPs) to about 18 Pa*sec (18,000 cPs), and more preferably from about 10 Pa*sec (10,000 cPs) to about 14 Pa*sec (14,000 cPs). Without the fragrance and fragrance stabilizer, the composition generally has a viscosity between about 5 Pa*sec (5,000 cPs) to about 25 Pa*sec (25,000 cPs), preferably from about 10 Pa*sec (10,000 cPs) to about 20 Pa*sec (20,000 cPs), and more preferably from about 11 Pa*sec (11,000 cPs) to about 16 Pa*sec (16,000 cPs). Viscosities indicated are those which would be measured using a Brookfield viscometer Model RVF with a TB spindle at 10 rpm at 77° F. (25° C.).

The thickener may be an acrylic thickener or a polymeric thickener. Suitable acrylic thickeners are conventionally known as "carbopols." A preferred thickener is available under the trade designation CARBOPOL 1342 available from B. F. Goodrich, Cleveland, Ohio. CARBOPOL 1342 is an acrylic acid copolymer resin. Suitable polymeric thickeners also include, for example, cellulose gums, acrylic polymers, xanthan gums, and magnesium aluminum silicate. Other useful thickeners may include activated Laponite resins. Laponite resins are synthetic smectite clay materials available from Southern Clay Products, Gonzales, Tex., USA, 78629. The composition generally includes thickener in an amount of less than 3.0 percent by weight, preferably between about 0.1 percent and about 1.0 percent by weight, and more preferably between about 0.15 percent and about 0.5 percent by weight.

Neutralizing Agent

Depending on the type of thickener used in the composition, a neutralizing agent may be employed to increase the pH of the composition, and thereby permit the thickener to thicken. Suitable neutralizing agents include conventional bases such as, for example, sodium hydroxide and ammonia, and amine containing compounds such as triethanolamine. A preferred neutralizing agent is triethanolamine, available from Huntsman Petrochemical Corporation, Houston, Tex. The amount of neutralizing agent included in the composition depends on the type and amount of thickener used and also depends on the desired viscosity of the composition. The composition generally includes a neutralizing agent in an amount of less than 5 percent by weight, preferably between about 0.5 percent and about 5.0 percent by weight, and more preferably between about 0.5 percent and about 3.0 percent by weight.

Ultra-Violet Light Absorber

An ultra-violet (UV) light absorber is included in the composition to provide protection for the treated surface against the harmful affects of ultra-violet light. The UV absorber is preferably soluble in silicone oil. A preferred UV light absorber is UVINUL N-3039, a substituted propenoic acid (2-ethylhexyl-2-cyano-3,3'diphenyl acrylate) available from BASF Corporation, Charlotte, N.C. The composition generally includes a UV absorber in an amount of less than 5 percent by weight, preferably between about 0.1 percent and about 1.0 percent by weight, and more preferably between about 0.3 percent and about 0.8 percent by weight.

Fragrance and Fragrance Stabilizer

A fragrance and fragrance stabilizer are optionally but preferably provided in the composition. The fragrance stabilizer serves to slow the rate of dissipation of the fragrance from the composition. A preferred fragrance stabilizer is PERMETHYL 102A, a volatile hydrocarbon compound available from Presperse, Inc., South Plainfield, N.J. Suitable fragrances are available from Dragoco, Totowa, N.J. The composition generally includes fragrance in an amount of less than 5 percent by weight, preferably between about 1.0 percent and about 3.0 percent by weight, and more preferably between about 1.0 percent and about 2.0 percent by weight. The composition generally includes a fragrance stabilizer in an amount of less than 5 percent by weight, preferably between about 1.0 percent and about 3.0 percent by weight, and more preferably between about 1.0 percent and about 2.0 percent by weight.

Water

The composition also includes water in an amount between 50 and 80 percent by weight, preferably between about 55 percent and about 70 percent by weight, and more preferably between about 60 percent and 70 percent by weight. A portion of the water may be provided by the silicone emulsion and the portion of water which is not provided by the silicone emulsion is preferably provided as deionized water added to the composition.

Other ingredients, such as biocides, fungicides, freeze-thaw stabilizers, colorants, preservatives, and other additives may also be added to the composition.

The compositions of the present invention can generally be prepared by combining the thickener and water and mixing until the thickener is completely dissolved. The cleaners are then separately combined with the UV absorber and are mixed thoroughly. The silicone and neutralizing agent are then added to the cleaner/UV absorber mixture and are mixed to form a solution. Next, the thickener/water solution is mixed with the solution of cleaner, UV absorber, silicone, and neutralizing agent until a homogeneous mixture is formed. Last, the fragrance stabilizer and the fragrance are thoroughly mixed into the composition. An optional final step may include further adjusting the viscosity of the composition by adding additional water, thickener, or neutralizing agent.

EXAMPLES

In order that the invention described herein can be more fully understood, the following examples are set forth. It should be understood that the examples are for illustrative purposes only, and are not to be construed as limiting this invention in any manner.

The samples were prepared according to the compositions below. All percentages are given in terms of weight based on the total weight of the composition unless indicated otherwise.

Ingredients

The following is a summary of the various ingredients used to prepare the compositions in each of the Examples:

Propylene glycol monomethylether—a water soluble cleaning agent available from Olin Chemicals, Brandenburg, Ky.

Isopropanol—a common solvent also known as isopropyl alcohol.

GENESEE GP-7105-E—an amino functional silicone-wax grafted copolymer emulsion available from Genesee Polymer Corporation, Flint, Mich.

Union Carbide ALE-75—an organosilicone emulsion available from Witco Corporation, Friendly, W. Va.

CARBOPOL 1342—an acrylic acid copolymer resin, which serves as a thickener, available from B. F. Goodrich, Cleveland, Ohio.

Triethanolamine—a neutralizing agent available from Huntsman Petrochemical Corporation, Houston, Tex.

UVINUL N-3039—a substituted propenoic acid (2-ethylhexyl-2-cyano-3,3'diphenyl acrylate), which serves as a UV light absorber, available from BASF Corporation, Charlotte, N.C.

PERMETHYL 102A—a volatile hydrocarbon compound, which serves as a fragrance stabilizer, available from Presperse, Inc., South Plainfield, N.J.

Fragrances—various suitable fragrances are available from Dragoco, Totowa, N.J.

Water—deionized water.

Comparative Example 1

The following formulation corresponds to SCOTHGUARD Protective Gel sold by the Minnesota Mining and Manufacturing Company, St. Paul, Minn.

| Item | Weight % |
|---|---|
| Water | 62.9* |
| Carbopol 1342 (thickener) | 0.75 |
| Isopropanol (cleaner) | 4.0 |
| Propylene glycol monomethylether (cleaner) | 6.0 |
| UVINUL N-3039 (UV absorber) | 2.0 |
| Genesee GP 7105E (silicone) | 15.0 (6 silicone**) |
| Union Carbide ALE-75 (silicone) | 7.5 (4.1 silicone**) |
| Triethanolamine (neutralizing agent) | 1.9 |

*Genesee GP 7105E contains 40 percent water and therefore contributes 6 percent of the total water. Union Carbide ALE-75 contains 40 percent water and therefore contributes 3 percent of the total water. Thus, 9 percent of the water in the composition is provided by the silicone emulsions and 53.9 percent of the water in the composition is provided as deionized water.

**Genesee GP 7105E contains 40 percent silicone and Union Carbide ALE-75 contains 55 percent silicone. Thus the composition contains 10.1 percent silicone by weight.

The composition had the texture of a thick paste which was not easy to spread and did not exhibit favorable coverage properties. The composition had a viscosity of approximately 65 Pa*sec (65,000 cPs).

Comparative Examples 2–4

The viscosity of several commercially available protectants was also measured. The results are summarized in the following table:

| Example | Name | Viscosity |
|---|---|---|
| 2 | STP SON OF A GUN Protectant | 3.8 cPs |
| 3 | ARMOR ALL Protectant | 4.2 cPs |
| 4 | TURTLE WAX FORMULA 2001 Super Protectant with Sun Stop | 4.5 cPs |

All viscosities were measured with a Brookfield viscometer model LVT using spindle 1 at 60 rpm at 77° F. (25° C.). STP SON OF A GUN Protectant is available from First Brands Inc., Danbury, Conn. ARMOR ALL Protectant is available from Armor All Products Corporation, Aliso Viejo, Calif. TURTLE WAX FORMULA 2001 Super Protectant with Sun Stop is available from Turtle Wax Inc., Chicago, Ill. As shown in the table, each protectant in Examples 2–4 was found to have a very low viscosity which allowed the solution to be dispensed using a manually operated pump spray dispenser.

Example 1

| Item | Weight % |
|---|---|
| Deionized Water | 56.8* |
| Carbopol 1342 (thickener) | 0.3 |
| Isopropanol (cleaner) | 4.0 |
| Propylene glycol monomethylether (cleaner) | 6.0 |
| UVINUL N-3039 (UV absorber) | 0.5 |
| Genesee GP 7105E (silicone) | 20.0 (8 silicone**) |
| Union Carbide ALE-75 (silicone) | 7.5 (4.1 silicone**) |
| Triethanolamine (neutralizing agent) | 1.9 |
| Permethyl 102A (fragrance stabilizer) | 1.5 |
| Fragrance | 1.5 |

*Genesee GP 7105E contains 40 percent water and therefore contributes 8 percent of the total water. Union Carbide ALE-75 contains also 40 percent water and therefore contributes 3 percent of the total water. Thus, 11 percent of the water in the composition is provided by the silicone emulsions and 45.8 percent of the water in the composition is provided as deionized water.

**Genesee GP 7105E contains 40 percent silicone and Union Carbide ALE-75 contains 55 percent silicone. Thus the composition contains 12.1 percent silicone by weight.

The sample was prepared by mixing the Carbopol 1342 thickener and deionized water until the thickener was completely dissolved. Next, the isopropanol and propylene glycol monomethylether were combined with the UVINUL N-3039 ultra-violet light absorber and were mixed thoroughly. The Genesee GP 7105E and Union Carbide ALE-75 silicones and triethanolamine neutralizing agent were then added to the cleaner/UV absorber mixture and were mixed until a solution was formed. Next, the solution of thickener and water was mixed with the solution of cleaner, UV absorber, silicone, and neutralizing agent until a homogeneous mixture was formed. Last, the Permethyl 102A fragrance stabilizer and then the fragrance were thoroughly mixed into the mixture.

The composition had a viscosity of 12 Pa*sec (12,000 cPs) as measured using a Brookfield Viscometer Model RVF using a TB spindle at 10 rpm at 77° F. (25° C.) supplied by Brookfield Engineering Laboratories Inc., Stoughton, Mass.

The patents, patent documents, and patent applications cited herein are incorporated by reference in their entirety as if each were individually incorporated by reference. It will be apparent to those of ordinary skill in the art that various changes and modifications may be made without deviating from the inventive concept set forth above. Thus, the scope of the present invention should not be limited to the structures described in this application, but only by the structures described by the language of the claims and the equivalents of those structures.

What is claimed is:

1. A liquid protectant composition comprising:

(a) between about 1 percent and about 15 percent by weight cleaning agent comprising at least one of an alcohol, ether, and an acetate;

(b) between about 5 percent and about 15 percent by weight silicone;

(c) between about 0.1 percent and about 1.0 percent by weight thickener;

(d) between about 0.5 percent and about 5.0 percent by weight neutralizing agent;

(e) between about 0.1 percent and about 1.0 percent by weight ultra-violet light absorber;

(f) between about 1.0 percent and about 5.0 percent by weight fragrance;

(g) between about 1.0 percent and about 5.0 percent by weight fragrance stabilizer; and (h) between about 55 percent and about 70 percent by weight water;

wherein said composition has a viscosity ranging from about 7,500 to about 18,000 centipoise.

2. A liquid protectant composition as defined in claim 1, wherein the alcohol is one of ethanol, butanol, and isopropanol.

3. A liquid protectant composition as defined in claim 1, wherein the cleaning agent is propylene glycol alkyl ether.

4. A liquid protectant composition as defined in claim 1, wherein the cleaning agent is monomethyl ether.

5. A liquid protectant composition as defined in claim 1, wherein the cleaning agent is dimethyl ether.

6. A liquid protectant composition as defined in claim 1, wherein said cleaning agent is a mixture of propylene glycol monomethylether and isopropanol.

7. A liquid protectant composition comprising:

(a) between about 1 percent and about 15 percent by weight cleaning agent comprising at least one of pinene, camphene, terpinene, limonene, terpinolene, terpineol, linaleol;

(b) between about 5 percent and about 15 percent by weight silicone;

(c) between about 0.1 percent and about 1.0 percent by weight thickener;

(d) between about 0.5 percent and about 5.0 percent by weight neutralizing agent;

(e) between about 0.1 percent and about 1.0 percent by weight ultra-violet light absorber;

(f) between about 1.0 percent and about 5.0 percent by weight fragrance;

(g) between about 1.0 percent and about 5.0 percent by weight fragrance stabilizer; and (h) between about 55 percent and about 70 percent by weight water;

wherein said composition has a viscosity ranging from about 7,500 to about 18,000 centipoise.

* * * * *